US006845795B2

(12) United States Patent
Lammers et al.

(10) Patent No.: US 6,845,795 B2
(45) Date of Patent: Jan. 25, 2005

(54) PORTABLE HANDHELD SHARPENER WITH LOOP ATTACHMENT

(75) Inventors: Anthony J. Lammers, Gates Mills, OH (US); John R. Nottingham, Bratenahl, OH (US); John W. Spirk, Gates Mills, OH (US); Jeffrey Scott Plantz, Medina, OH (US); Patrick W. Brown, Auburn, OH (US)

(73) Assignee: InnoDesk Business Tools Inv., Warrensville Heights, OH (US)

( * ) Notice: Subject to any disclaimer, the term of this patent is extended or adjusted under 35 U.S.C. 154(b) by 0 days.

(21) Appl. No.: 10/205,240

(22) Filed: Jul. 25, 2002

(65) Prior Publication Data

US 2004/0016476 A1 Jan. 29, 2004

(51) Int. Cl.[7] ..... B43L 23/00

(52) U.S. Cl. ..... 144/28.5; 144/28.6; 144/28.7; 144/28.72

(58) Field of Search ..... 144/28.1, 28.3, 144/28.4, 28.5, 28.6, 28.7, 28.72, 28.2; 30/451, 453, 454, 455, 456, 457, 458

(56) References Cited

U.S. PATENT DOCUMENTS 3,889,730 A * 6/1975 Buc ..... 144/28.5
4,966,208 A * 10/1990 Uang ..... 144/28.72
5,077,903 A * 1/1992 Kreim ..... 30/451

* cited by examiner

*Primary Examiner*—Allen Ostrager
*Assistant Examiner*—S Self
(74) *Attorney, Agent, or Firm*—DKW Law Group; Roberta R. Wilson; William P. Smith

(57) ABSTRACT

A portable, handheld sharpener having an elongated body with loop attachments, a battery-operated DC motor with speed reducing gears and a gear plate and a rotatable sharpening unit. A pouch-shaped waste shavings receptacle detachably attached to the body provides a larger cross-sectional dimension ergonomically contoured to fit within the grip of a hand while providing increased internal space for waste shavings storage. An actuator button is molded into the receptacle and is partially circumscribed to provide a hinge-like action to engage a leaf spring connecting the battery source to the motor and also provides a momentary operation of the sharpener while in the original retail packaging. The actuator button will not operate when the receptacle is detached from the sharpener and the internal sharpening unit is exposed, thus acting as a safety feature. In other alternate embodiments, the looped attachments may be spaced to fit a three-ringed binder, different sharpening units sized to sharpen either pencils or crayons may be used, the unit may be designed to use replaceable sharpening units to prolong the useful life of the sharpener, and the unit is provided with stabilizers adjacent to the actuator button to prevent the unit from freely rolling around.

68 Claims, 6 Drawing Sheets

PORTABLE HANDHELD SHARPENER WITH LOOP ATTACHMENT

RELATED APPLICATIONS

There are no prior applications related to this invention anywhere in the world.

BACKGROUND OF THE INVENTION

1. Field of the Invention

This invention pertains generally to a powered sharpener and, more particularly, to a portable battery-operated handheld device for sharpening wood pencils and other articles that has a looped means for attaching the sharpener to other articles.

2. Description of the Prior Art

Widespread access to the Internet and technological advancements in affordable personal computers has had a dramatic effect on educational and workplace environments in the new millennium. Many educational and work activities no longer take place in centralized locations and may even take place at home or at temporary locations during travel. As a result, there is now an increased demand for portable office equipment and office products geared for consumer use.

A portable battery-operated pencil sharpener designed for consumer use would ideally be lightweight and have a compact, slender size that can be securely stored while being transported. It would also be easy to safely operate and have a durable yet simplistic design that would reduce production costs and the ultimate price to the consumer.

Portable battery-operated pencil sharpeners disclosed in the prior art generally do not provide all of these characteristics. For example, U.S. Pat. No. 3,889,730 discloses a stout, cylindrical exterior that is suitable for placing on a table or attaching to a drafting board by use of an integral mounting clip. U.S. Pat. No. 6,249,982 B1 has a similar stout cylindrical exterior. U.S. Pat. No. 4,050,487 discloses a more slender exterior shape; however, the invention does not disclose a specific means for emptying the shaving receptacle and does not disclose an external attaching device or a safety mechanism for disabling the cutter blades while removing shavings from the sharpener. Similarly, U.S. Pat. No. 6,065,514 discloses a slender portable battery-operated device suitable for sharpening cosmetic pencils that are comprised of an inner casing of soft wax-like cosmetic material; however, it does not disclose a safety mechanism for disabling the cutter blades while removing shavings from the sharpener or any external attaching device. Finally, none of these prior inventions provides for any means to prolong the sharpening life of the device.

Thus, what is lacking in the prior art is a low cost, portable, durable, powered sharpener that can be carried securely by being attached to a ringed binder or clipped to another article without employing a purse or clothing pockets, and that is ergonomically designed for handheld use, with safety and design features optimally suited for consumer use. 0

SUMMARY OF THE INVENTION

It is an object of this invention to provide a low cost, portable, durable, powered sharpener that can be carried securely by being attached to a ringed binder or clipped to another article without employing a purse or clothing pockets, and that is ergonomically designed for handheld use, with safety and design features optimally suited for consumer use.

It is another object of the present invention to provide a rotating sharpener cartridge driven by a DC motor coupled to a battery power source through a switch to provide a switch operated pencil sharpener with shut-off safety features. A convex receptacle is attached to the body of the sharpener device with a hollow pouch-like interior to provide means for storing waste shavings and is detachable for removal of the waste shavings. The receptacle includes a switch button that cannot be operated when the receptacle is detached from the body. This feature operates as a safety device so as to prevent accidental operation of the sharpener when the receptacle is removed from the body and the blade is exposed and also allows a test operation of the sharpener without removing the sharpener from the retail packaging.

It is a further object of the invention to provide an enlarged storage compartment for waste shavings, to reduce blockage of the sharpener and the need for frequently emptying of the compartment.

It is a further object of the invention to provide an electric pencil sharpener having one or more loops made from rope-like material for attaching to a ringed loose-leaf binder, clip, hook or loop.

It is an object of the present invention to provide a battery-powered pencil sharpener having a rotating, replaceable sharpening cartridge.

It is an additional object of the present invention to provide an alternate sharpening unit designed to provide a blunter tip suited for softer wax-like drawing instruments with the option to have the sharpening unit replaceable with either a blunt tip sharpening unit or one that produces a finer tip suitable for writing instruments such as a lead-tip pencil.

These and other objects are obtained with the present invention which is directed to a portable handheld sharpener with loop attachments which includes:

- a body having an elongated, hollow shape and a front opening at one end with a front cap attached to the front opening, the front cap having an aperture and an inwardly projecting sleeve for inserting an article to be sharpened;
- a receptacle for waste shavings detachably attached at a second opening of the body adjacent to the front cap;
- a sharpening unit rotatably positioned within the body and adjacent to the aperture in the front cap, the sharpening unit being comprised of a housing, an aperture leading to a hollow tapered recess within the housing, the housing also having an opening and at least one blade mounted in the housing at least partially penetrating the opening to engage the end of the object to be sharpened;
- a direct current electric motor coupled to the sharpening unit;
- a power source comprised of one or more batteries;
- an end cap removably fitted to the body at the end opening of the body opposite the front opening for access to the batteries for battery insertion and removal;
- a switch means for connecting the batteries to the motor to energize the motor;
- a plurality of gears adapted to reduce the speed of the sharpening unit; and
- an attachment means comprised of one or more looped hanging straps attached to a top of the body for attaching the sharpener to a fastener.

In one embodiment of the present invention, the receptacle is sized and contoured so that when the receptacle is fully attached to the body of the sharpener, the receptacle provides a larger cross-sectional dimension to the body that is contoured to fit within the grip of a hand.

In another embodiment of the present invention, the switch means is comprised of an actuator button disposed within the receptacle and adapted for switching a plurality of conductive wires between the power source with the drive means and a conductive leaf spring; the leaf spring when depressed by contact by means of the actuator button completes an electrical circuit between the power source and the drive means. The receptacle is comprised of a flexible material, the actuator button has a convex bubble molded as a contiguous part of the receptacle, a raised actuator disposed on-the convex inner surface of the bubble and a partially circumscribing slot to permit flexing of the actuator button, with the actuator button being disposed within the receptacle so as to avoid depression by contact when the sharpener is laid on a flat surface.

In another embodiment of the present invention, the speed-reducing gears are each mounted on a boss on a gear plate with each boss being of graduated height so that each gear intermeshes to the successive gear to provide speed reduction relative to motor speed.

In another embodiment of the present invention, the looped hanging straps attached to the top of the body are dimensioned to attach the sharpener to a standard ringed binder.

In another embodiment of the present invention, the sharpening blade is disposed at an angle suitable to produce a fine tapered point suitable for writing, while in another embodiment, one blade is disposed at an angle suitable to produce a blunt point suitable for drawing instruments comprised of a wax-like material.

In another embodiment of the present invention, the sharpening unit is pressure fitted to the drive shaft on the drive means and the front cap is further comprised of a removable snap-on cap, the inwardly projecting sleeve being pressure fitted to the sharpening unit so that the front cap may be removed and the sharpening unit may be replaced.

In another embodiment of the present invention, the batteries are housed in a slide-out battery cartridge holding the batteries in place and providing easier insertion and removal of the batteries.

In another embodiment of the present invention, stabilizers protruding on either side of the actuator bottom allow the sharpener to sit in an upright position precluding the sharpener from freely rolling around.

A complete understanding of the invention will be obtained from the following description when taken in connection with the accompanying drawing figures, wherein like references numbers identify like parts throughout.

DETAILED DESCRIPTION OF THE INVENTION

Figure 1:
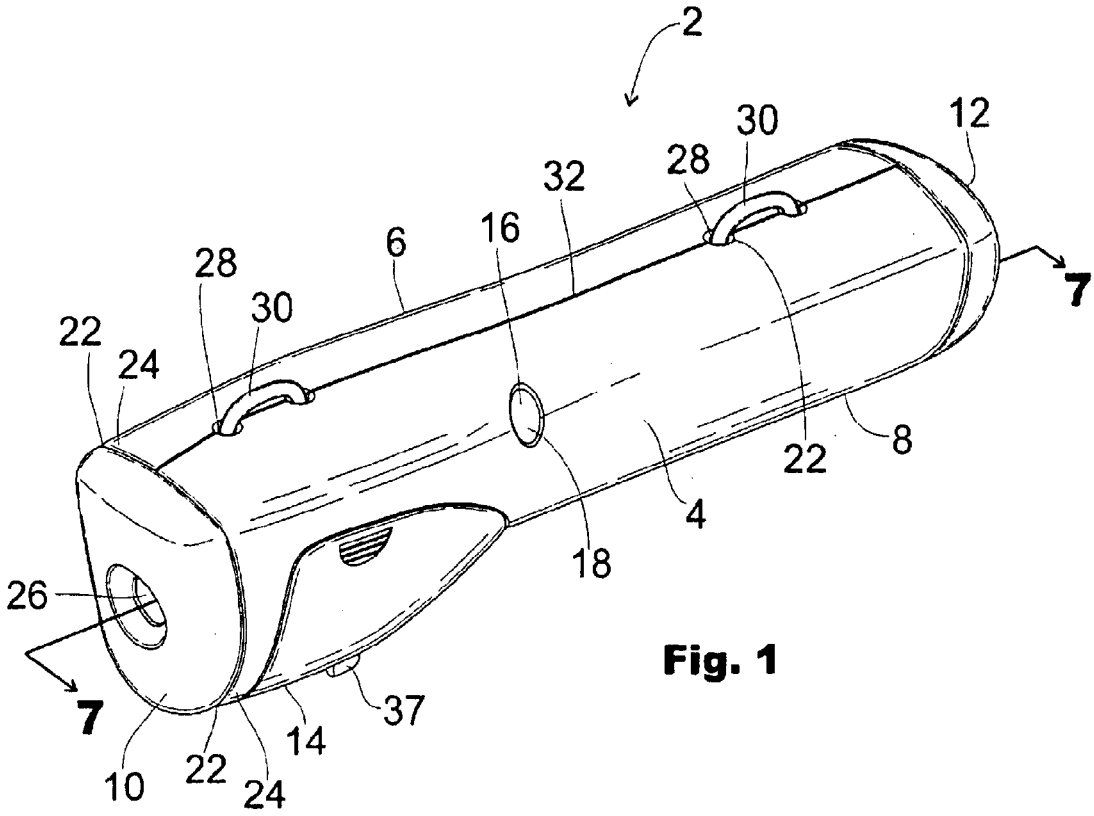
FIG. 1 is a perspective view of an embodiment of the invention.
Figure 2:
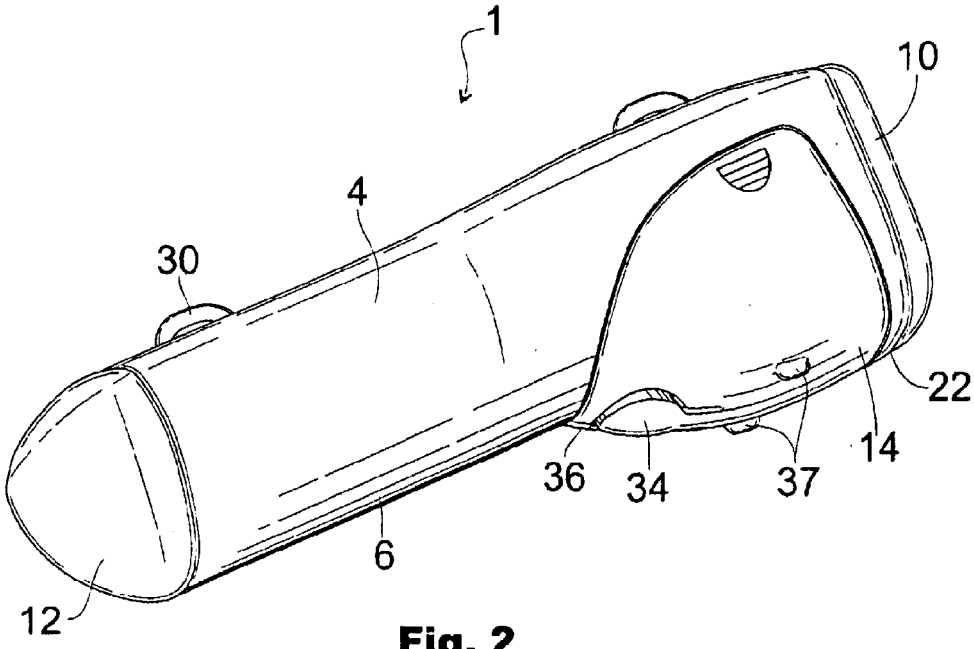
FIG. 2 is a perspective view of an embodiment of the invention, taken from the rear.

Referring first to the external features of a preferred embodiment of the invention, in FIG. 1 and FIG. 2 the pencil sharpener is generally designated as 2. An elongated body 4 of the sharpener 2 is comprised of a right housing 6 and a left housing 8 with a first front cap 10, a removable second rear battery cap 12 and a removable receptacle 14 for waste shavings.

The right housing 6 and left housing 8 are joined by one or more housing attachment screws 16, each entering a depressed screw hole 18 in the left housing 8 and threadably engaged in a threaded receptacle molded to the interior side (not shown) of the right housing 6. The right housing 6 and left housing 8 are also held in position by interlocking tabs 20 on the interior side of the right housing 6, left housing 8 and the front cap 10 and further secured by a lipped edge 22 of front cap 10 which fits retentively over front ends 24 of the right housing 6 and left housing 8. The front cap 10 has an aperture 26 for insertion of a pencil or other article to be sharpened.

Notches 28 in the top edges of the right housing 6 and left housing 8 form openings in the sharpener body 4 that allow the top half of looped hanging straps 30 to protrude from the interior of sharpener 2 along a top parting line 32. The hanging straps 30 are placed at a distance from each other to be compatible with attachment, for example, to standard-sized ringed binders for easy storage and secure carrying. Alternatively, the hanging straps 30 provide a general means of attachment to any type of fastener that would permit the sharpener to be attached by a spring clip, hook or key chain ring to any number of articles such as a belt, belt loop or backpack.

The combined shape of the right housing 6 and left housing 8 and the receptacle 14 is contoured to fit ergonomically within the grip of a hand with the fingers grasping around the wider cross-sectional dimension of the waste receptacle 14 and the thumb resting upon a molded actuator button 34. The actuator button 34 is nestled at the base of a curve 36 of the receptacle 14 so that the actuator button 34 cannot be accidentally depressed by the weight of the sharpener thereby activating the sharpener 2 while it rests on a flat surface such as a desk or table.

A plurality of molded stabilizers 37 comprised of the same or similar material as the receptacle protrudes from the surface of the receptacle to allow the sharpener to sit in an upright position precluding the sharpener from freely rolling.

Figure 3:
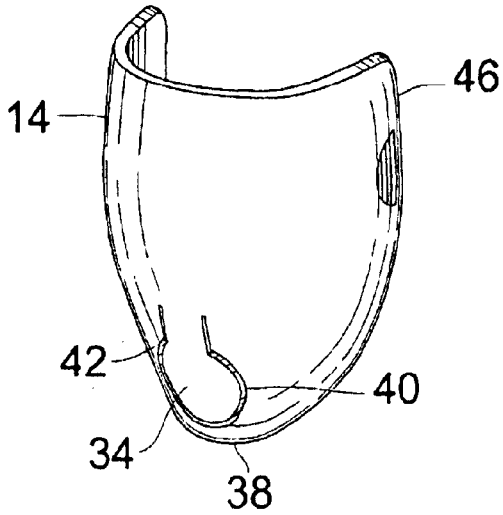
FIG. 3 is a perspective view of the receptacle of an embodiment of the present invention, in the detached position.
Figure 4:
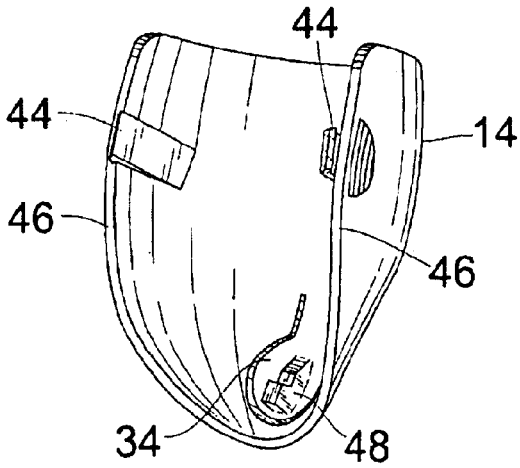
FIG. 4 is a perspective view of the receptacle of an embodiment of the invention, in the detached position, taken from the reverse direction.
Figure 5:
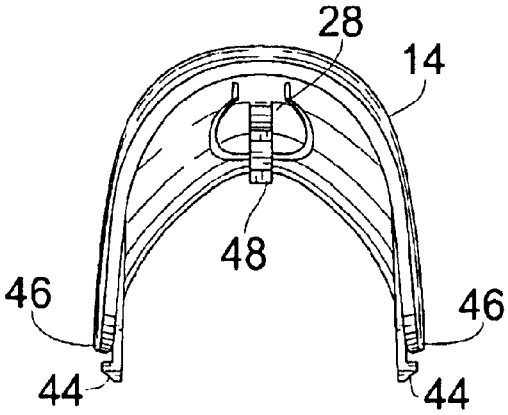
FIG. 5 is an end view of the receptacle of an embodiment of the invention, in the detached position.

FIG. 3, FIG. 4 and FIG. 5 depict the features of the actuator button 34 with the receptacle 14 in the detached position. The actuator button 34 is comprised of the same or similar flexible material as the receptacle 14 and is molded as a continuous part of the receptacle 14. Actuator button 34 is formed integrally with receptacle 14 as a convex surface bubble 38, partially circumscribed by a slot 40 between the convex surface bubble 38 and the receptacle 14. The receptacle 14 and surface bubble 38 are joined at a junction 42. Junction 42 serves as a natural or "living" hinge without having any component parts that would increase production costs or that could fail with repeated use. The receptacle material has sufficient elasticity to allow actuator button 34 to flex at junction 42 when depressed, and return to its original "off" position when released.

Molded pressure clips 44 at right and left top edges 46 of the receptacle 14 secure the receptacle 14 in the attached position. A raised actuator 48 is molded into the interior surface of the molded actuator button 34 on the convex interior of bubble 38. As will be discussed in greater detail below with reference to FIG. 7, when the receptacle 14 is attached to the body of the pencil sharpener and the actuator button 34 depressed, the actuator 48 depresses a leaf spring 50 into contact with a metal motor 52 housing to complete the electrical circuit to power the sharpener 2. The motor 52 housing is made of a suitable electric conductive material. The resilient characteristics of the molded actuator button 34 cause the actuator button 34 to snap back to its original molded position when thumb pressure on the actuator button 34 ceases, moving the actuator 48 out of contact with the leaf spring 50 and breaking the contact between the leaf spring 50 and the metal motor 52 housing. The receptacle 14 must be attached to the body 4 of the sharpener 2 in order for it to operate. This feature operates as a safety device so as to prevent accidental operation of the sharpener 2 when the receptacle 14 is removed from the body 4 and the sharpening unit 60 and blade 90, as shown in FIG. 6, are exposed, thereby preventing injury to the operator or a child.

Figure 9:
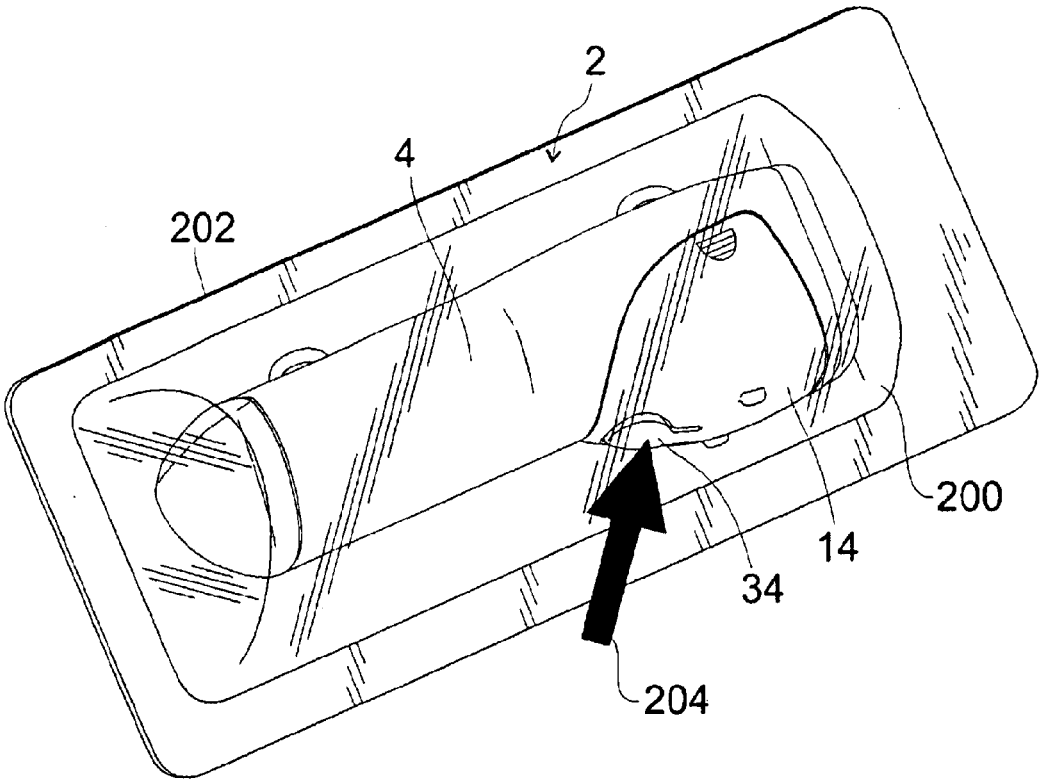
FIG. 9 is a perspective view showing the sharpener enclosed in the packaging.

The momentary operation of actuator button 34 also provides a means for test operation of the sharpener 2 that may be used while the sharpener 2 is still wrapped in the original protective retail packaging. As shown in FIG. 9, the packaging may be comprised of a transparent thin plastic barrier 200 molded around at least a portion of the sharpener 2 including the receptacle 14 and the actuator button 34 and the plastic barrier 200 is adhesively or mechanically attached to a backing sheet of cardboard 202, with the sharpener 2 secured between the plastic barrier 200 and the cardboard 202. The plastic is pliable, so that the actuator button 34 may be depressed to turn on the sharpener 2 while in the packaging. The actuator button 34 is returned to the off position when released, thereby avoiding unintended drainage of the batteries in the sharpener 2. This feature advantageously invites the consumer to test-operate the device before purchasing.

Figure 6:
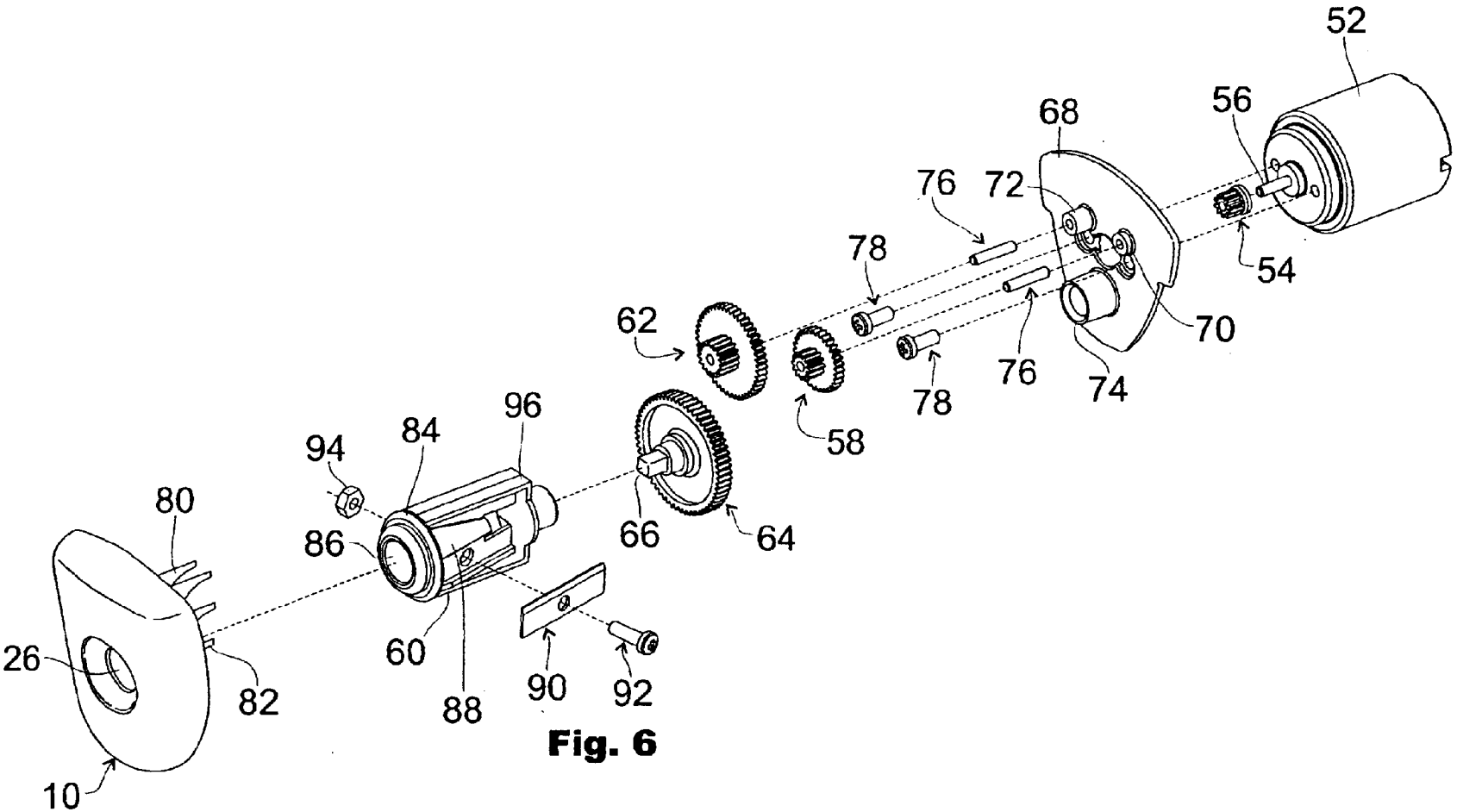
FIG. 6 is a partial exploded perspective view of the internal parts of an embodiment of the invention.

FIG. 6 is an exploded view of the internal arrangement between the motor, reducing gears, sharpener and front cap. A pinion gear 54 fixed to a shaft 56 on the motor 52 meshes with a gear 58 to reduce the speed of a sharpening unit 60 by their gear ratio. Similarly, a gear 62 meshes with gear 58 and gear 62 in turn meshes with a gear 64 to successively reduce the speed to the desired revolutions per minute (rpms) for operating the sharpening unit 60 which is attached to gear 64 by a connecting drive shaft 66. Gear 58, gear 62 and gear 64 are affixed to a gear plate 68 on boss 70, boss 72 and boss 74, which are of graduated heights, by gear shafts 76 and gear screws 78. This gear arrangement operates to compact the linear distance between the gears.

The interior side of the front cap 10 has an inwardly projecting sleeve 80 surrounding the aperture 26 in the front cap 10. A distal end 82 of the sleeve 80 is notched to provide a pressure fit over an outer edge 84 outside the periphery of an insertion aperture 86 in the sharpening unit 60 allowing sleeve 80 to act as a radial shoulder that directs the pencil inserted in the aperture 26 on the exterior side of the front cap 10 into a hollow tapered recess 88 within the sharpening unit 60. A cutting blade 90 is attached to the sharpener unit 60 by a blade screw 92 and a blade nut 94. Alternatively, a blade may be molded right into a housing 96 of the sharpener unit 60. The tapering of recess 88 and blade 90 alignment is disposed at an angle suitable to produce a fine tapered point, or alternatively to produce a blunt point suitable for drawing instruments comprised of a waxlike material such as crayons.

In another preferred embodiment of the invention, the sharpening unit 60 is attached to the connecting drive shaft 66 by a snap-on fitting and maintained in position by a slight pressure fitting between the distal end 82 of sleeve 80 and the outer edge 84 outside the periphery of the insertion aperture 86 in the sharpening unit 60. The sharpening unit 60 can be removed from the drive shaft 66 by removing the snap-on front cap 10 and by pulling off sharpening unit 60. A replacement sharpening unit with a blade angle suitable for pencil sharpening could then be inserted onto the connecting drive shaft 66 and the front cap 10 would be snapped back in place. Alternatively, a replacement sharpening unit with a blade angle providing for a blunter wide angle point could be inserted for sharpening crayons and similar types of wax-like materials. The replaceable feature of the sharpening unit enhances the efficiency of the sharpener and prolongs its useful life. It will be readily appreciated by one skilled in the art to modify the means of coupling the drive shaft 66 with the sharpening unit 60 such as by substituting a reverse threaded spindle or a clevis, all of which are considered to be within the scope of this invention.

Figure 7:
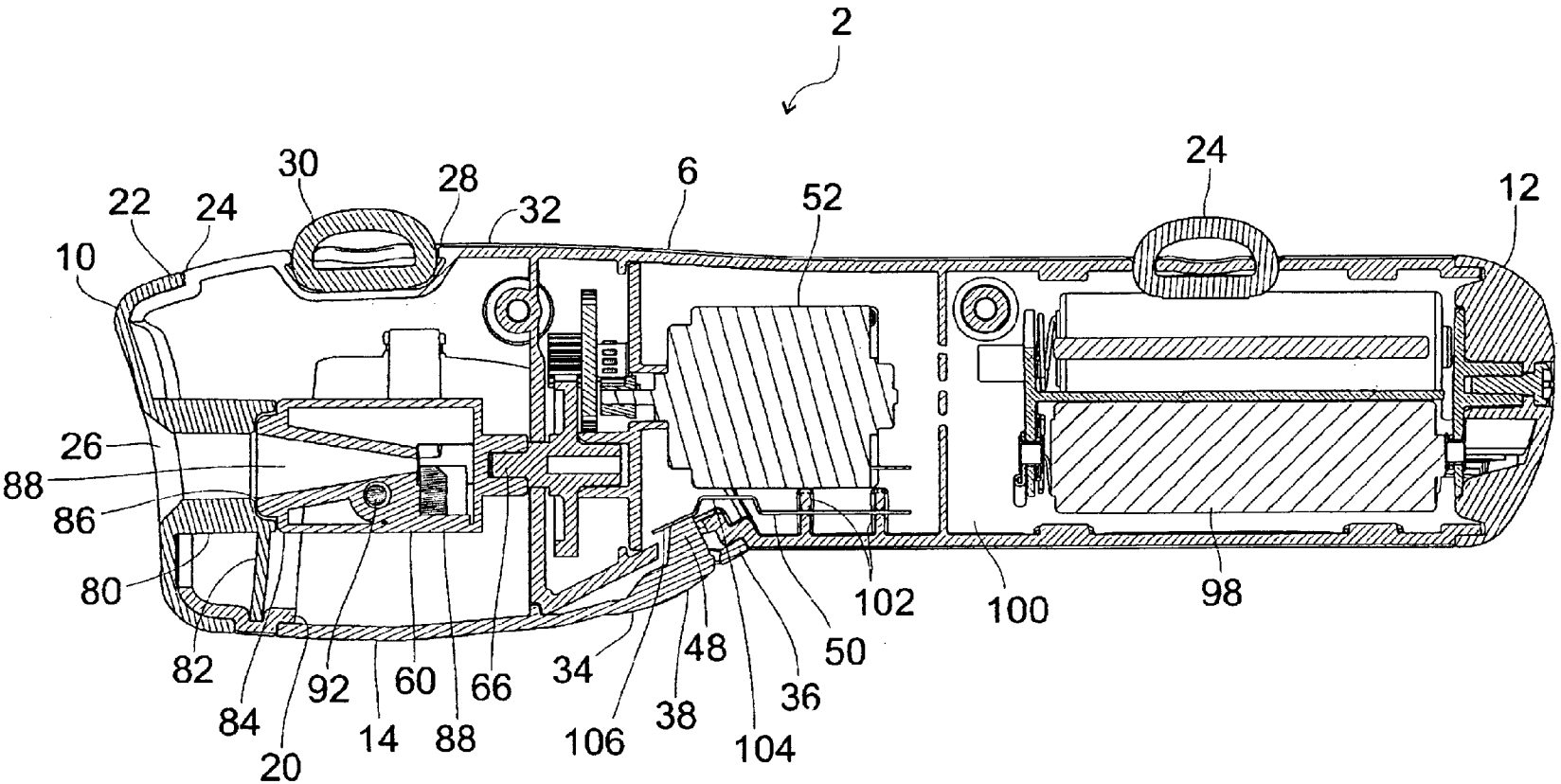
FIG. 7 is a cross-sectional view of an embodiment of the invention taken along the lines 7—7 in FIG. 1.

The compact internal arrangement of a preferred embodiment of this invention is depicted in FIG. 7. Gear 58, gear 62 and gear 64 attached to the gear plate 68 work to accomplish the necessary motor speed reduction in a reduced axial length. Additionally, the enlarged circumference produced by the pouched-shaped receptacle 14 provides greater internal space for storing waste shavings. The actuator button 34 is also situated in close proximity to the motor 52 to provide for a compact electrical circuit connection.

As discussed above, in a disclosed embodiment the miniature direct current motor 52 is electrically powered by batteries 98 contained in a rear compartment 100 formed by the right housing 6 and left housing 8. Leaf spring 50 is supported on bushings 102, spaced parallel to the motor 52 housing. One end of leaf spring 50 is connected to the negative polarity battery contact by an insulated conducting wire (not shown). Another insulated conducting wire (not shown) is connected to the motor winding in the direct current motor and to the positive battery contact. The opposite end of leaf spring 50 has a raised indentation 104 with a distal end 106 projecting downward at an angle. The distal end 106 rests adjacent or against the actuator 48. The raised indentation 104 is spaced apart from the motor 52 housing in close proximity, such that the actuator 48, when depressed against the distal end 106, causes indentation 104 to make electrical contact with the motor 52 housing thereby completing the electric circuit and activating the motor 52 to turn the sharpening unit 60. Leaf spring 50 is comprised of a formed, metallic strip of conductive material. The metal strip is preferably copper or aluminum and has sufficient resiliency to cause it to spring back to the original resting position of leaf spring 50 when the actuator button 34 is released. Electrical contact is thereby broken when the actuator button 34 is released causing the motor 52 to turn off.

Figure 8:
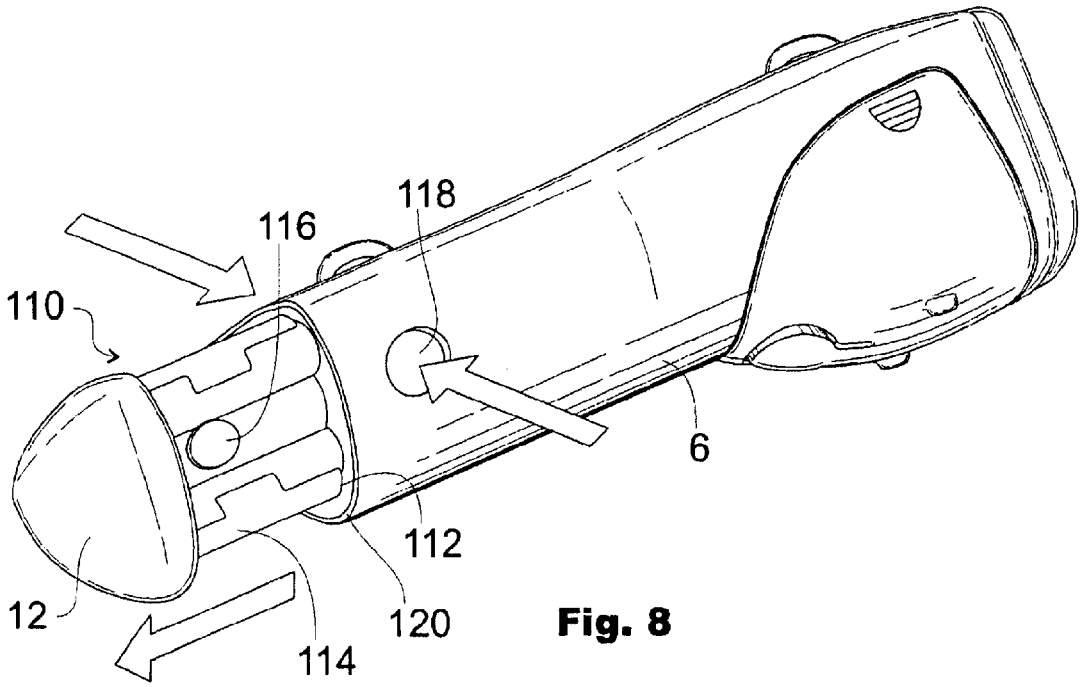
FIG. 8 is a perspective view of an alternate embodiment of the invention taken from the rear showing the battery cartridge removed.

FIG. 8 depicts a slide-out battery cartridge 110 feature of another preferred embodiment of this invention. In this embodiment, the second rear battery cap 12 is affixed to the slide-out battery cartridge 110 comprised of an insertion end 112, cartridge sides 114, negative and positive battery contacts (not shown) secured together to form a single battery cartridge unit. One or more raised buttons 116 are affixed to the cartridge sides, the cartridges sides being flexible enough to allow the raised button to be depressed for entry into the sharpener housing and to flex out to the original position when the raised button slides under and then protrudes through a bore hole 118 in the housing, locking the cartridge in the attached position. The second rear battery cap 12 is affixed to the battery cartridge 110 by means of a fastener (not shown) and the second rear battery cap 12 fits retentively over the rear ends 120 of the right housing 6 and left housing (not shown).

Although the invention has been described above by reference to preferred embodiments of the invention, the invention is not limited to the embodiments described above. Modifications and variations of the embodiments described above will occur to those skilled in the art, in light of the above teachings without departing from the spirit of the invention. It is the intention, therefore, to be limited only as indicated by the scope of the claims appended hereto.

We claim:

1. A portable, handheld sharpener comprising:

a. a body having an elongated, hallow shape and a first opening at one end;

b. a first cap attached to said first opening, the first cap having a first aperture and an inwardly projecting sleeve for inserting an article to be sharpened;

c. a receptacle for waste shavings detachably attached at a second opening of said body adjacent to the first cap;

d. a sharpening unit rotatably positioned within the body and adjacent to the first aperture wherein the shapening unit is comprised of a housing; a second aperture leading to a hollow tapered recess within the housing; said housing also having a fourth opening and at least one blade mounted in the housing at least partially penetrating the fourth opening to engage the end of the object to be sharpened;

e. a drive means coupled to the sharpening unit wherein the drive means is comprised of a plurality of gears adapted to reduce the speed of the sharpening unit;

f. a means for accommodating a power source comprised of an internal compartment for housing one or more batteries; the drive means is comprised of a direct current electric motor coupled to the sharpening unit by a drive shaft and the sharpener is further comprised of a second end cap removably fitted to the body at a third opening of said body opposite the first opening for access to said batteries for battery insertion and removal; and g. a switch means for connecting the power source and the drive means to energize the drive means wherein the switch means is comprised of an actuator button disposed within the receptacle and adapted for switching of a plurality of conductive wires between the power source with the drive means and a conductive leaf spring; said leaf spring when depressed by contact by means of the actuator button completes an electrical circuit between the power source and the drive means.

2. The sharpener of claim 1 wherein said receptacle is comprised of a flexible material; said actuator button having a convex bubble molded as a contiguous part of the receptacle, a raised actuator disposed on the convex inner surface of the bubble and a partially circumscribing slot to permit flexing of the actuator button, said actuator button being disposed within the receptacle so as to avoid depression by contact when the sharpener is laid on a flat surface.

3. The sharpener of claim 2 wherein the plurality of said gears are each mounted on a boss of a gear plate, said plurality of bosses being of graduated height thereby intermeshing each gear to the successive gear and providing speed reduction relative to motor speed.

4. The sharpener of claim 3 also comprised of an attachment means fixed to the body for attaching the sharpener to a fastener.

5. The sharpener of claim 4 wherein the attachment means is comprised of one or more looped hanging straps attached to a top of the body, said straps being dimensioned to attach the sharpener to a standard ringed binder.

6. The sharpener of claim 5 wherein said at least one blade is disposed at an angle suitable to produce a fine tapered point suitable for writing.

7. The sharpener of claim 5 wherein the sharpening unit is pressure fitted to the drive shaft on the drive means and the first cap is further comprised of a removable snap-on cap, the inwardly projecting sleeve being pressure fitted to the sharpening unit so that the front cap may be removed and the sharpening unit may be replaced.

8. The sharpener of claim 5 wherein the said at least one blade is disposed at an angle suitable to produce a blunt point suitable for drawing instruments comprised of a wax-like material.

9. The sharpener of claim 5 wherein the body has one or more bore holes adjacent to the third opening of said body and the second end cap is secured to a battery cartridge, said battery cartridge being comprised of an insertion end, negative and positive battery contacts, and cartridge sides, said cartridge sides being contoured to fit within the body and partially wrap around the exterior surface of said batteries; said cartridge sides being further comprised of a flexible material and one or more raised buttons which project through said bore holes when said cartridge is in the inserted position.

10. The sharpener of claim 5 wherein a plurality of stabilizers protrudes from the surface of the receptacle adjacent to the actuator button allowing the sharpener to sit in an upright position on a surface and partially elevated to prevent accidental contact of the surface with the actuator button.

11. The sharpener of claim 5 wherein said sharpener is held within a package providing a means for momentarily operating said sharpener while the sharpener is inside the packaging and a means for automatically returning said sharpener to an inoperative state while still inside the packaging.

12. A portable, handheld sharpener comprising:

a. a body having an elongated hollow shape and a first opening at one end;

b. a first cap attached to said first opening, the first cap having a first aperture and an inwardly projecting sleeve for inserting an article to be sharpened;

c. a receptacle for waste shavings detachably attached at a second opening of said body adjacent to the first cap wherein the receptacle when fully attached to said body provides a larger cross-sectional dimension to said body, said dimension being contoured to fit within the grip of a hand;

d. a sharpening unit rotatably positioned within the body and adjacent to the first aperture;

e. a direct current electric motor coupled to the sharpening unit;

f. a means for accommodating a power source comprised of one or more batteries;

g. a second end cap removably fitted to the body at a third opening of said body opposite the first opening for access to said batteries for battery insertion and removal;

h. a switch means for connecting the batteries to the motor to energize the motor; and i. a plurality of gears adapted to reduce the speed of the sharpening unit wherein the plurality of said gears are each mounted on a boss of a gear plate, said plurality of bosses being of graduated height thereby intermeshing each gear to the successive gear and providing speed reduction relative to motor speed.

13. The sharpener of claim 12 wherein the sharpening unit is comprised of a housing; a second aperture leading to a hollow tapered recess within the housing; said housing also having a fourth opening and at least one blade mounted in the housing at least partially penetrating the fourth opening to engage the end of the object to be sharpened.

14. The sharpener of claim 12 wherein the switch means is comprised of an actuator button disposed within the receptacle and adapted for switching of a plurality of conductive wires between the power source with the drive means and a conductive leaf spring; said leaf spring when depressed by contact by means of the actuator button completes an electrical circuit between the power source and the drive means.

15. The sharpener of claim 12 wherein said receptacle is comprised of a flexible material; said actuator button having a convex bubble molded as a contiguous part of the receptacle, a raised actuator disposed on the convex inner surface of the bubble and a partially circumscribing slot to permit flexing of the actuator button, said actuator button being disposed within the receptacle so as to avoid depression by contact when the sharpener is laid on a flat surface.

16. The sharpener of claim 12 also comprised of an attachment means fixed to the body for attaching the sharpener to a fastener.

17. The sharpener of claim 16 wherein the attachment means is comprised of one or more looped hanging straps attached to a top of the body, said straps being dimensioned to attach the sharpener to a standard ringed binder.

18. The sharpener of claim 13 wherein said at least one blade is disposed at an angle suitable to produce a fine tapered point suitable for writing.

19. The sharpener of claim 13 wherein the sharpening unit is pressure fitted to a drive shaft on the drive means and the first cap is further comprised of a removable snap-on cap, the inwardly projecting sleeve being pressure fitted to the sharpening unit so that the front cap may be removed and the sharpening unit may be replaced.

20. The sharpener of claim 13 wherein the said at least one blade is disposed at an angle suitable to produce a blunt point suitable for drawing instruments comprised of a wax-like material.

21. The sharpener of claim 12 wherein the body has one or more bore holes adjacent to the third opening of said body and the second end cap is secured to a battery cartridge, said battery cartridge being comprised of an insertion end, negative and positive battery contacts, and cartridge sides, said cartridge sides being contoured to fit within the body and partially wrap around the exterior surface of said batteries; said cartridge sides being further comprised of a flexible material and one or more raised buttons which project through said bore holes when said cartridge is in the inserted position.

22. The sharpener of claim 15 wherein a plurality of stabilizers protrudes from the surface of the receptacle adjacent to the actuator button allowing the sharpener to sit in an upright position on a surface and partially elevated to prevent accidental contact of the surface with the actuator button.

23. The sharpener of claim 15 wherein said sharpener is held within a package providing a means for momentarily operating said sharpener while the sharpener is inside the packaging and a means for automatically returning said sharpener to an inoperative state while still inside the packaging.

24. A portable, handheld sharpener comprising:

a. a body having an elongated hollow shape and a first opening at one end;

b. a first cap attached to said first opening, the first cap having a first aperture and an inwardly projecting sleeve for inserting an article to be sharpened;

c. a receptacle for waste shavings detachably attached at a second opening of said body adjacent to the first cap, wherein said receptacle is comprised of a flexible material; said receptacle when fully attached to said body provides a larger cross-sectional dimension to said body, said dimension being contoured to fit within the grip of a hand;

d. a sharpening unit rotatably positioned within the body and adjacent to the first aperture;

e. a direct current electric motor coupled to the sharpening unit;

f. a means for accommodating a power source comprised of one or more batteries;

g. a second end cap removably fitted to the body at a third opening of said body opposite the first opening for access to the batteries for battery insertion and removal; and h. a switch means for connecting the batteries to the motor to energize the motor, wherein the switch means is comprised of a plurality of conductive wires between the power source with the drive means and a conductive leaf spring; said leaf spring when depressed by contact by means of an actuator button completes an electrical circuit between the power source and the drive means; said actuator button having a convex bubble molded as a contiguous part of the receptacle, a raised actuator disposed on the convex inner surface of the bubble and a partially circumscribing slot to permit flexing of the actuator button, said actuator button being disposed within the receptacle so as to avoid depression by contact when the sharpener is laid on a flat surface.

25. The sharpener of claim 24 wherein the drive means is also comprised of a plurality of gears adapted to reduce the speed of the sharpening unit.

26. The sharpener of claim 25 wherein the sharpening unit is comprised of a housing; a second aperture leading to a hollow tapered recess within the housing; said housing also having a fourth opening and at least one blade mounted in the housing at least partially penetrating the fourth opening to engage the end of the object to be sharpened.

27. The sharpener of claim 26 wherein the plurality of said gears are each mounted on a boss of a gear plate, said plurality of bosses being of graduated height thereby intermeshing each gear to the successive gear and providing speed reduction relative to motor speed.

28. The sharpener of claim 27 also comprised of an attachment means fixed to the body for attaching the sharpener to a fastener.

29. The sharpener of claim 28 wherein the attachment means is comprised of one or more looped hanging straps attached to a top of the body, said straps being dimensioned to attach the sharpener to a standard ringed binder.

30. The sharpener of claim 28 wherein said at least one blade is disposed at an angle suitable to produce a fine tapered point suitable for writing.

31. The sharpener of claim 28 wherein the sharpening unit is pressure fitted to a drive shaft on the drive means and the first cap is further comprised of a removable snap-on cap, the inwardly projecting sleeve being pressure fitted to the sharpening unit so that the front cap may be removed and the sharpening unit may be replaced.

32. The sharpener of claim 28 wherein the said at least one blade is disposed at an angle suitable to produce a blunt point suitable for drawing instruments comprised of a wax-like material.

33. The sharpener of claim 28 wherein the body has one or more bore holes adjacent to the third opening of said body and the second end cap is secured to a battery cartridge, said battery cartridge being comprised of an insertion end, negative and positive battery contacts, and cartridge sides, said cartridge sides being contoured to fit within the body and partially wrap around the exterior surface of said batteries; said cartridge sides being further comprised of a flexible material and one or more raised buttons which project through said bore holes when said cartridge is in the inserted position.

34. The sharpener of claim 28 wherein a plurality of stabilizers protrudes from the surface of the receptacle adjacent to the actuator button allowing the sharpener to sit in an upright position on a surface and partially elevated to prevent accidental contact of the surface with the actuator button.

35. The sharpener of claim 28 wherein said sharpener is held within a package providing a means for momentarily operating said sharpener while the sharpener is inside the packaging and a means for automatically returning said sharpener to an inoperative state while still inside the packaging.

36. A portable, handheld sharpener comprising:

a. a body having an elongated hollow shape and a first opening at one end;

b. a first cap attached to said first opening, the first cap having a first aperture and an inwardly projecting sleeve for inserting an article to be sharpened;

c. a receptacle for waste shavings detachably attached at a second opening of said body adjacent to the first cap;

d. a sharpening unit rotatably positioned within the body and adjacent to the first aperture;

e. a drive means coupled to the sharpening unit;

f. a means for accommodating a power source;

g. a switch means for connecting the power source and the drive means to energize the drive means; and h. an attachment means comprised of one or more looped hanging straps attached to a top of the body for attaching the sharpener to a fastener.

37. The sharpener of claim 36 wherein said straps being dimensioned to attach the sharpener to a standard ringed binder.

38. The sharpener of claim 36 wherein the means for accommodating the power source is comprised of an internal compartment housing one or more batteries; the drive means is comprised of a direct current electric motor and the sharpening unit is further comprised of a second end cap removably fitted to the body at a third opening of said body opposite the first opening for access to said batteries for battery insertion and removal.

39. The sharpener of claim 38 wherein the drive means is further comprised of a plurality of gears adapted to reduce the speed of the sharpening unit.

40. The sharpener of claim 36 wherein the sharpening unit is comprised of a housing; a second aperture leading to a hollow tapered recess within the housing; said housing also having a fourth opening and at least one blade mounted in the housing at least partially penetrating the fourth opening to engage the end of the object to be sharpened.

41. The sharpener of claim 36 wherein the switch means is comprised of an actuator button disposed within the receptacle and adapted for switching a plurality of conductive wires between the power source with the drive means and a conductive leaf spring; said leaf spring when depressed by contact by means of the actuator button completes an electrical circuit between the power source and the drive means.

42. The sharpener of claim 36 wherein said body is comprised of a flexible material; said actuator button having a convex bubble molded as a contiguous part of the receptacle, a raised actuator disposed on the convex inner surface of the bubble and a partially circumscribing slot to permit flexing of the actuator button, said actuator button being disposed within the receptacle so as to avoid depression by contact when the sharpener is laid on a flat surface.

43. The sharpener of claim 39 wherein the plurality of said gears are each mounted on a boss of a gear plate, said plurality of bosses being of graduated height thereby intermeshing each gear to the successive gear and providing speed reduction relative to motor speed.

44. The sharpener of claim 40 wherein said at least one blade is disposed at an angle suitable to produce a fine tapered point suitable for writing.

45. The sharpener of claim 40 wherein the sharpening unit is pressure fitted to a drive shaft on the drive means and the first cap is further comprised of a removable snap-on cap, the inwardly projecting sleeve being pressure fitted to the sharpening unit so that the front cap may be removed and the sharpening unit may be replaced.

46. The sharpener of claim 40 wherein the said at least one blade is disposed at an angle suitable to produce a blunt point suitable for drawing instruments comprised of a wax-like material.

47. The sharpener of claim 38 wherein the body has one or more bore holes adjacent to the third opening of said body and the second end cap is secured to a battery cartridge, said battery cartridge being comprised of an insertion end, negative and positive battery contacts, and cartridge sides, said cartridge sides being contoured to fit within the body and partially wrap around the exterior surface of said batteries; said cartridge sides being further comprised of a flexible material and one or more raised buttons which project through said bore holes when said cartridge is in the inserted position.

48. The sharpener of claim 41 wherein a plurality of stabilizers protrudes from the surface of the receptacle adjacent to the actuator button allowing the sharpener to sit in an upright position on a surface and partially elevated to prevent accidental contact of the surface with the actuator button.

49. The sharpener of claim 43 wherein said sharpener is held within a package providing a means for momentarily operating said sharpener while the sharpener is inside the packaging and a means for automatically returning said sharpener to an inoperative state while still inside the packaging.

50. A portable, handheld sharpener comprising:

a. a body having an elongated hollow shape and a first opening at one end;

b. a first cap attached to said first opening, the first cap having a first aperture and an inwardly projecting sleeve for inserting an article to be sharpened;

c. a receptacle for waste shavings comprised of flexible material and detachably attached at a second opening of said body adjacent to the first cap, said receptacle when fully attached to said body provides a larger cross-sectional dimension to said body, said dimension being contoured to fit within the grip of a hand;

d. a sharpening unit rotatably positioned within the body and adjacent to the first aperture, wherein the sharpening unit is comprised of a housing; a second aperture leading to a hollow tapered recess within the housing; said housing also having a fourth opening and at least one blade mounted in the housing at least partially penetrating the fourth opening to engage the end of the object to be sharpened;

e. a direct current electric motor coupled to the sharpening unit;

f. a means for accommodating a power source comprised of one or more batteries;

g. a second end cap removably fitted to the body at a third opening of said body opposite the first opening for access to said batteries for battery insertion and removal;

h. a switch means comprised of an actuator button disposed within the receptacle, said actuator button having a convex bubble molded as a contiguous part of the receptacle, a raised actuator disposed on the convex inner surface of the bubble and a partially circumscribing slot to permit flexing of the actuator button, said actuator button being disposed within the receptacle so as to avoid depression by contact when the sharpener is laid on a flat surface and adapted for switching of a plurality of conductive wires between the power source with the drive means and a conductive leaf spring; said leaf spring when depressed by contact by means of the actuator button completes an electrical circuit between the power source and the drive means;

i. a plurality of gears adapted to reduce the speed of the sharpening unit wherein the plurality of said gears are each mounted on a boss of a gear plate, said plurality of bosses being of graduated height thereby intermeshing each gear to the successive gear and providing speed reduction relative to motor speed; and j. an attachment means comprised of a plurality of looped hanging straps attached to a top of the body, said straps being dimensioned to attach the sharpener to a standard ringed binder.

51. The sharpener of claim 50 wherein said at least one blade is disposed at an angle suitable to produce a fine tapered point suitable for writing.

52. The sharpener of claim 50 wherein the sharpening unit is pressure fitted to a drive shaft on the drive means and the first cap is further comprised of a removable snap-on cap, the inwardly projecting sleeve being pressure fitted to the sharpening unit so that the front cap may be removed and the sharpening unit may be replaced.

53. The sharpener of claim 50 wherein the said at least one blade is disposed at an angle suitable to produce a blunt point suitable for drawing instruments comprised of a wax-like material.

54. The sharpener of claim 50 wherein the body has one or more bore holes adjacent to the third opening of said body and the second end cap is secured to a battery cartridge, said battery cartridge being comprised of an insertion end, negative and positive battery contacts, and cartridge sides, said cartridge sides being contoured to fit within the body and partially wrap around the exterior surface of said batteries; said cartridge sides being further comprised of a flexible material and one or more raised buttons which project through said bore holes when said cartridge is in the inserted position.

55. The sharpener of claim 50 wherein a plurality of stabilizers protrudes from the surface of the receptacle adjacent to the actuator button allowing the sharpener to sit in an upright position on a surface and partially elevated to prevent accidental contact of the surface with the actuator button.

56. The sharpener of claim 50 wherein said sharpener is held within a package providing a means for momentarily operating said sharpener while the sharpener is inside the packaging and a means for automatically returning said sharpener to an inoperative state while still inside the packaging.

57. An electric pencil sharpening device comprising:

a. an elongated hollow body open at one end and having a receptacle detachably mounted thereto;

b. a front cover detachably mounted to said body to cover said open end, said front cover also having an aperture for insertion of a pencil;

c. an electric motor disposed within said body, said electric motor coupled by an electrical circuit to a battery power source, wherein said motor having a first shaft, said first shaft being coupled to said sharpening means through a speed reducing means and a second shaft, said speed reducing means comprising a plurality of meshed gears, and wherein said meshed gears having a predetermined ratio to reduce the speed of said second shaft relative to the speed of said first shaft;

d. switching means for actuating said motor; and e. sharpening means coupled to said motor within said body, said sharpening means rotatable relative to said body to cut a tapered point on a pencil for writing.

58. The electric pencil sharpening device as set forth in claim 57 wherein said switching means being comprised of an actuator button and a contact means, and said actuator button being integral with said receptacle so as to prevent the motor from operating when the receptacle is detached from said body.

59. The electric pencil sharpening device as set forth in claim 58 wherein said actuator button also comprising a raised projection adjacent to said contact means, wherein depressing said actuator button urges said projection against said contact means and into contact with said motor to close the electrical circuit between the motor and said one or more batteries.

60. The electric pencil sharpening device as set forth in claim 57 wherein said sharpening means comprising a housing having an aperture and a tapered conical inner wall defining an opening at least partially herethrough to an end point; one or more linear slots disposed in said inner wall; a razor blade having an edge projecting at least partially into the opening; a recess adjacent said second shaft adapted for coupling thereto; and a fastening means adjacent said aperture for connection to the body at said open end.

61. The electric pencil sharpening device as set forth in claim 57 wherein the body has one or more bore holes adjacent to the third opening of said body and the second end cap is secured to a battery cartridge, said battery cartridge being comprised of an insertion end, negative and positive battery contacts, and cartridge sides, said cartridge sides being contoured to fit within the body and partially wrap around the exterior surface of said batteries; said cartridge sides being further comprised of a flexible material and one or more raised buttons which project through said bore holes when said cartridge is in the inserted position.

62. The electric pencil sharpening device as set forth in claim 58 wherein a plurality of stabilizers protrudes from the surface of the receptacle adjacent to the actuator button allowing the sharpener to sit in an upright position on a surface and partially elevated to prevent accidental contact of the surface with the actuator button.

63. An electric pencil sharpening device comprising:

a. an elongated hollow body open at one end and having a receptacle detachably mounted thereto, said detachable receptacle comprising a concave, enlarged compartment greater in cross section than said body for storage of waste shavings to reduce clogging of the sharpening means and providing increased storage volume for waste shavings;

b. a front cover detachably mounted to said body to cover said open end, said front cover also having an aperture for insertion of a pencil;

c. an electric motor disposed within said body, said electric motor coupled by an electrical circuit to a battery power source, wherein said motor having a first shaft, said first shaft being coupled to said sharpening means through a speed reducing means and a second shaft, said speed reducing means comprising a plurality of meshed gears, and wherein said meshed gears having a predetermined ratio to reduce the speed of said second shaft relative to the speed of said first shaft;

d. switching means for actuating said motor comprised of an actuator button and a contact means, and said actuator button being integral with said receptacle so as to prevent the motor from operating when the receptacle is detached from said body;

e. said actuator button also comprising a raised projection adjacent to said contact means wherein depressing said actuator button urges said projection against said contact means and into contact with said motor to close the electrical circuit between the motor and said one or more batteries;

f. sharpening means coupled to said motor within said body, said sharpening means rotatable relative to said body to cut a tapered point on a pencil for writing; and g. said sharpening means further comprising a housing having an aperture and a tapered conical inner wall defining an opening at least partially herethrough to an end point; one or more linear slots disposed in said inner wall; a razor blade having an edge projecting at least partially into the opening; a recess adjacent said second shaft adapted for coupling thereto; and a fastening means adjacent said aperture for connection to the body at said open end.

64. The electric pencil sharpening device as set forth in claim 63 wherein said pencil sharpening device also comprising at least one loop attached to said body for fastening said device to an attachment means selected from the group consisting of either a ring, a hook or a loop.

65. The electric pencil sharpening device as set forth in claim 63 wherein said body is comprised of two opposable side portions connected at a seam to define the hollow interior and joined by said front cover to prevent separation of the body at said seam.

66. The electric pencil sharpening device as set forth in claim 63 wherein the body has one or more bore holes adjacent to the third opening of said body and the second end cap is secured to a battery cartridge, said battery cartridge being comprised of an insertion end, negative and positive battery contacts, and cartridge sides, said cartridge sides being contoured to fit within the body and partially wrap around the exterior surface of said batteries; said cartridge sides being further comprised of a flexible material and one or more raised buttons which project through said bore holes when said cartridge is in the inserted position.

67. The electric pencil sharpening device as set forth in claim 63 wherein a plurality of stabilizers protrudes from the surface of the receptacle adjacent to the actuator button allowing the sharpener to sit in an upright position on a surface and partially elevated to prevent accidental contact of the surface with the actuator button.

68. The electric pencil sharpening device as set forth in claim 63 wherein said sharpener is held within a package providing a means for momentarily operating said sharpener while the sharpener is inside the packaging and a means for automatically returning said sharpener to an inoperative state while still inside the packaging.

* * * * *